US008616914B2

(12) United States Patent
Mumper et al.

(10) Patent No.: US 8,616,914 B2
(45) Date of Patent: Dec. 31, 2013

(54) CHECKABLE PLUG-IN CONNECTION AND METHOD FOR CHECKING THE CONNECTION STATE OF A PLUG-IN CONNECTION

(75) Inventors: Guenther Mumper, Egelsbach (DE); Yehya Ashour, Darmstadt (DE); Harmut Ripper, Darmstadt (DE)

(73) Assignee: Tyco Electronics AMP GmbH, Bensheim (DE)

( * ) Notice: Subject to any disclaimer, the term of this patent is extended or adjusted under 35 U.S.C. 154(b) by 241 days.

(21) Appl. No.: 13/056,531

(22) PCT Filed: Jul. 21, 2009

(86) PCT No.: PCT/EP2009/059336

§ 371 (c)(1),
(2), (4) Date: Jan. 28, 2011

(87) PCT Pub. No.: WO2010/012627

PCT Pub. Date: Feb. 4, 2010

(65) Prior Publication Data

US 2011/0195591 A1 Aug. 11, 2011

(30) Foreign Application Priority Data

Jul. 28, 2008 (DE) ..... 10 2008 035 193

(51) Int. Cl.
*H01R 3/00* (2006.01)

(52) U.S. Cl.
USPC ..... 439/489

(58) Field of Classification Search
USPC ..... 439/489
See application file for complete search history.

(56) References Cited

U.S. PATENT DOCUMENTS

| | | | | | |
|---|---|---|---|---|---|
| 5,112,246 | A * | 5/1992 | Kawase et al. | ..... | 439/489 |
| 5,120,255 | A * | 6/1992 | Kouda et al. | ..... | 439/489 |
| 5,192,225 | A * | 3/1993 | Suzuki | ..... | 439/489 |
| 5,330,369 | A * | 7/1994 | Nozaki et al. | ..... | 439/489 |
| 5,391,087 | A * | 2/1995 | Fukuda | ..... | 439/188 |
| 5,429,527 | A * | 7/1995 | Nozaki et al. | ..... | 439/489 |
| 5,928,038 | A * | 7/1999 | Berg et al. | ..... | 439/752 |
| 7,090,531 | B2 * | 8/2006 | Simmel | ..... | 439/489 |

FOREIGN PATENT DOCUMENTS

GB 2 246 030 A 1/1992

OTHER PUBLICATIONS

European Patent Office, Search Report and Written Opinion for PCT/EP2009/059336, dated Oct. 14, 2009.

* cited by examiner

*Primary Examiner* — Neil Abrams
(74) *Attorney, Agent, or Firm* — Faegre Baker Daniels LLP

(57) ABSTRACT

The present application relates to a checkable plug-in connection comprising a plug having at least one latching element, a verification element which is secured to the plug via a connection element so as to be prevented from being removed, and a mating plug which can be connected to the plug and comprises at least one counter-latching element. The plug-in connection is configured so as to be able to pass from a pre-connection configuration, in which the verification element is prevented from being removed from the plug by the connection element and in which the plug and mating plug are separate from one another, into an end connection configuration, in which the counter-latching element is engaged with the at least one latching element and in which the plug and mating plug are prevented from being pulled apart.

15 Claims, 9 Drawing Sheets

CHECKABLE PLUG-IN CONNECTION AND METHOD FOR CHECKING THE CONNECTION STATE OF A PLUG-IN CONNECTION

The present invention relates to a method for checking the connection state of a plug-in connection prevented from being pulled apart using a plug, a mating plug and a verification element.

The invention further relates to a plug combination for a checkable plug-in connection, having a plug which comprises at least one latching element, which can be engaged with at least one counter-latching element of a mating plug and is configured so as to prevent the plug and mating plug from being pulled apart when in an end connection configuration, and having a verification element which can be securely attached to the plug via a connection element, in which the plug combination is configured so as to be able to pass from an assembled configuration, in which the plug and verification element are separate from one another, into a pre-connection configuration in which the verification element is securely attached to the plug via the connection element.

The present invention also relates to a checkable plug-in connection comprising a plug having at least one latching element, a verification element which is prevented from being removed from the plug by a connection element, and a mating plug which can be connected to the plug and comprises at least one counter-latching element, in which the plug-in connection is configured so as to be able to pass from a pre-connection configuration, in which the verification element is prevented from being removed from the plug by the connection element and in which the plug and mating plug are separate from one another, into an end connection configuration, in which the at least one counter-latching element is engaged with the at least one latching element and in which the plug and mating plug are prevented from being pulled apart.

With electrical plug-in connections used in the automobile industry, it is necessary to connect plugs and mating plugs securely in such a way that it is impossible to pull the plug and mating plug apart without first releasing the securing lock.

In order to ensure that the plug-in connection is connected, connection position assurances are used in the prior art which secure the lock between the plug and mating plug.

EP 0 840 398 A1 discloses an electrical connection arrangement which comprises a connection position assurance device which is displaceably mounted on one of the latching elements of the connector housing between an inactive start position and an end display position for showing that the connectors have been connected.

Another plug-in connection having a connection position assurance is known from DE 101 59 956 A1. The connection position assurance of this plug-in connection is locked in a stored position on the housing of the plug-in connection and, once the plug-in connection has been inserted into the mating plug, may be actuated and guided into an end latched position, in which the connection position assurance is locked in place.

The electrical plug-in connection of DE 102 27 016 A1 comprises a connection position assurance which is secured on the plug-in connection in a pre-assembly position. When the plug-in connection is inserted into an insulating body of the corresponding socket, the insulating body releases the lock and the connection position assurance can then pass into the end position. In the end position the plug-in connection is locked together with the socket and this locked position is secured by the connection position assurance.

However, a drawback with known plug-in connections is that the connection state can only be checked if the plug-in connection is available for inspection. However, if an assembled unit has left the assembly station on a production line, at which station plugs and mating plugs are connected, it is not possible to later check at the assembly station whether the plug-in connection was also connected in the connection state.

It is thus an object of the present invention to provide a method for checking the connection state as well as a plug combination for a checkable plug-in connection and a checkable plug-in connection which can be constructed in a simple manner and makes it possible to check, even without a plug-in connection being present, whether the plug-in connection is in the correct connection state, in which the plug and mating plug are securely connected so as to be prevented from being pulled apart.

This object is achieved for the above-mentioned method for checking the connection state by the following steps:

a) securely attaching the verification element to the plug;
b) connecting the plug and mating plug;
c) locking together the plug and mating plug whilst simultaneously releasing the attachment of the verification element; and
d) removing the verification element from the plug.

The correct connection state can be easily checked with the method according to the invention by examining whether the verification element has been removed from the plug and is thus separate from the plug. The verification element is securely attached to the plug before the plug and mating plug are connected, i.e. the verification element and plug form a one-piece, operable unit, it only being possible to remove the verification element from the plug once the attachment of the verification element has been released. Since the attachment is released when the plug and mating plug are locked together, it is thus ensured that the verification element can only be removed from the plug once the correct connection state has been achieved.

By way of the method according to the invention it can be checked, in particular in a production line, whether the plug-in connections of all manufactured units are in the correct connection state. In order to do this, it is only necessary to compare the number of manufactured units with the number of removed verification elements. If these numbers are identical, it is known that all plug-in connections have been correctly connected.

For the abovementioned plug combination, the above object is achieved in that the connection element comprises a release means arranged so as to be able to be guided by the counter-latching element into a release position, in which the attachment of the connection element is released and the verification element can be removed from the plug. With the above-mentioned plug-in connection, the object is achieved in that in the end connection configuration the connection element is released from the at least one counter-latching element and the verification element can be removed from the plug.

This structurally simple solution ensures that the verification element can only be removed from the plug in the connection state of the end connection configuration in which the plug and mating plug cannot be pulled apart. In accordance with the invention, the verification element can only be removed from the plug once the connection element has been released. This release is effected by the counter-latching element in the end connection configuration, in which the counter-latching element acts directly or indirectly via intermediate elements on the release means of the connection element so as to perform the releasing process and guides said release means into the release position, in which the attachment of the connection element is released and the verification element can be removed from the plug.

The present invention may be further developed by various embodiments, each of which is advantageous per se and which can be combined in any desired manner. The individual advantageous embodiments and the advantages associated therewith will now be discussed briefly below.

The release means may be formed as part of the connection element or configured as a separate part. In the first case, the counter-latching element acts directly on the part of the connection element which forms the release means. This may, for example, be a release projection on the connection element. In the second case, the release element is arranged between the counter-latching element and the connection element and releases the connection element when actuated by the counter-latching element and in the end connection configuration.

In a first advantageous embodiment of the plug combination according to the invention, the release means may be arranged in a region in which the at least one counter-latching element is arranged in the end connection configuration. The release means is preferably arranged next to the at least one latching element, in some embodiments the release means being arranged directly on the latching means and in others the release means not directly contacting the latching means. By way of this arrangement of the release means, the counter-latching element acts directly on the release means of the connection element. This simplifies construction and assembly of the plug combination and plug-in connection since no additional components are required which indirectly guide the release means into the release position upon actuation of the counter-latching element.

This embodiment allows, for example, the method according to the invention to be carried out in an advantageous manner in which in step c) the verification element is released by locking the plug and mating plug together, i.e. the locking and releasing processes are directly connected.

It is also possible, by locking the plug and mating plug together, to produce a release mechanism which in turn releases the attachment of the verification element to the plug. This may be advantageous, for example, if the connection point at which the verification element is securely attached to the plug cannot be formed on the latching means of the plug owing to constructional restrictions. Releasing the verification element by locking the plug and mating plug together does, however, offer the advantage that no intermediate element is necessary and thus fewer components are required for the plug combination according to the invention. This increases the operational safety of the method according to the invention and of the plug combination or plug-in connection according to the invention.

In a further advantageous embodiment, the release means is formed on a resiliently deformable spring arm. A resiliently deformable spring arm is easy to produce. If the release means is arranged on the spring arm, it can be guided into the release position simply by deflecting the spring arm, in which release position the attachment of the connection element is released.

In a further advantageous embodiment of the method the verification element may be locked together with the plug in step a). As a positive connection, this locking process ensures in a constructionally simple manner that the verification element is securely attached to the plug. Alternatively, the verification element may be securely fixed to the plug via a non-positive or material connection.

The spring arm may advantageously comprise a first fixing means which, together with a second fixing means, forms the attachment of the connection element in the pre-connection configuration. Together with the resiliently deformable spring arm, the connection element may thus form the part of a snap connection which enables secure locking. A snap connection is simple to produce and is a repeatedly lockable connection which, in particular, offers the advantage that not only can the correct connection state of the plug-in connection be checked via the removed verification element, but the verification elements can also be used repeatedly and in other plug combinations.

The release means may advantageously be provided on the first fixing means. The counter-latching element of the mating plug thus acts directly on the first fixing means via the release means, and can remove said first fixing means from the second fixing element of the plug and thus release the attachment of the connection element.

For locking, the first fixing means may be a fixing lug projecting from the spring arm, which lug engages in a latching opening forming the second fixing means in the pre-connection configuration. Alternatively, the first fixing means may be a fixing recess formed in the spring arm, in which recess a latching projection forming the second fixing means engages in the pre-connection configuration.

In a further advantageous embodiment of the plug combination, the at least one latching element of the plug may form the second fixing means. The connection element configured as a resiliently deformable spring arm is thus directly connected to the latching element of the plug via its first fixing means. The connection element is thus directly and securely attached to the latching element of the plug in a structurally compact manner. The release of the connection element is also facilitated by the at least one counter-latching means of the mating plug. The first fixing means is arranged on the latching means, i.e. precisely where the counter-latching means is arranged in the end connection configuration, the attachment thus being released.

In an advantageous embodiment of the plug combination, the connection element may be formed on the verification element. Alternatively, the connection element may be formed on the plug. It is also possible to use a separate part as the connection element, which part is arranged in the pre-connection configuration between the verification element and the plug, connecting these two elements. However, forming the connection element on the verification element or on the plug reduces the number of elements required and simplifies assembly.

In a further advantageous embodiment the plug may comprise a guide extending in the removal direction for removing the verification element. The direction in which the verification element is removed from the plug is thus defined. At the same time, the guide fixes the verification element transverse to the removal direction.

The guide may advantageously comprise at least one guide groove (13*a*) extending substantially in the removal direction, which guide groove is cooperatively configured with at least one guide projection of the verification element. A guide groove may be easily formed in the plug. Furthermore, the at least one guide projection of the verification element, when said projection is in the guide groove and cooperates therewith as a guide, is a bearing for a verification element having a spring arm, which bearing encourages the resilient deformation of the spring arm.

The guide groove preferably extends substantially in the plug-in direction in which the plug and mating plug are connected. In step d) of the method according to the invention, the verification element may thus be removed against the plug-in direction in which the plug and mating plug are connected together in step b). This has the advantage that the plug is again released from the mating plug, provided the plug and mating plug were not locked correctly in the connection state. In this case, the verification element would still be securely attached to the plug, a pulling movement against the plug-in direction pulling the plug combination out of the plug and thus pulling the verification element out of the mating plug against the plug-in direction.

The invention will be described hereinafter in an exemplary manner and with reference to the accompanying drawings. The various features may be combined independently of one another or omitted, as shown above in the individual advantageous embodiments.

FIGS. 1 to 10 show the plug-in connection 1 and plug combination 2 according to the invention as an electrical plug-in connection 1.

Figure 1:
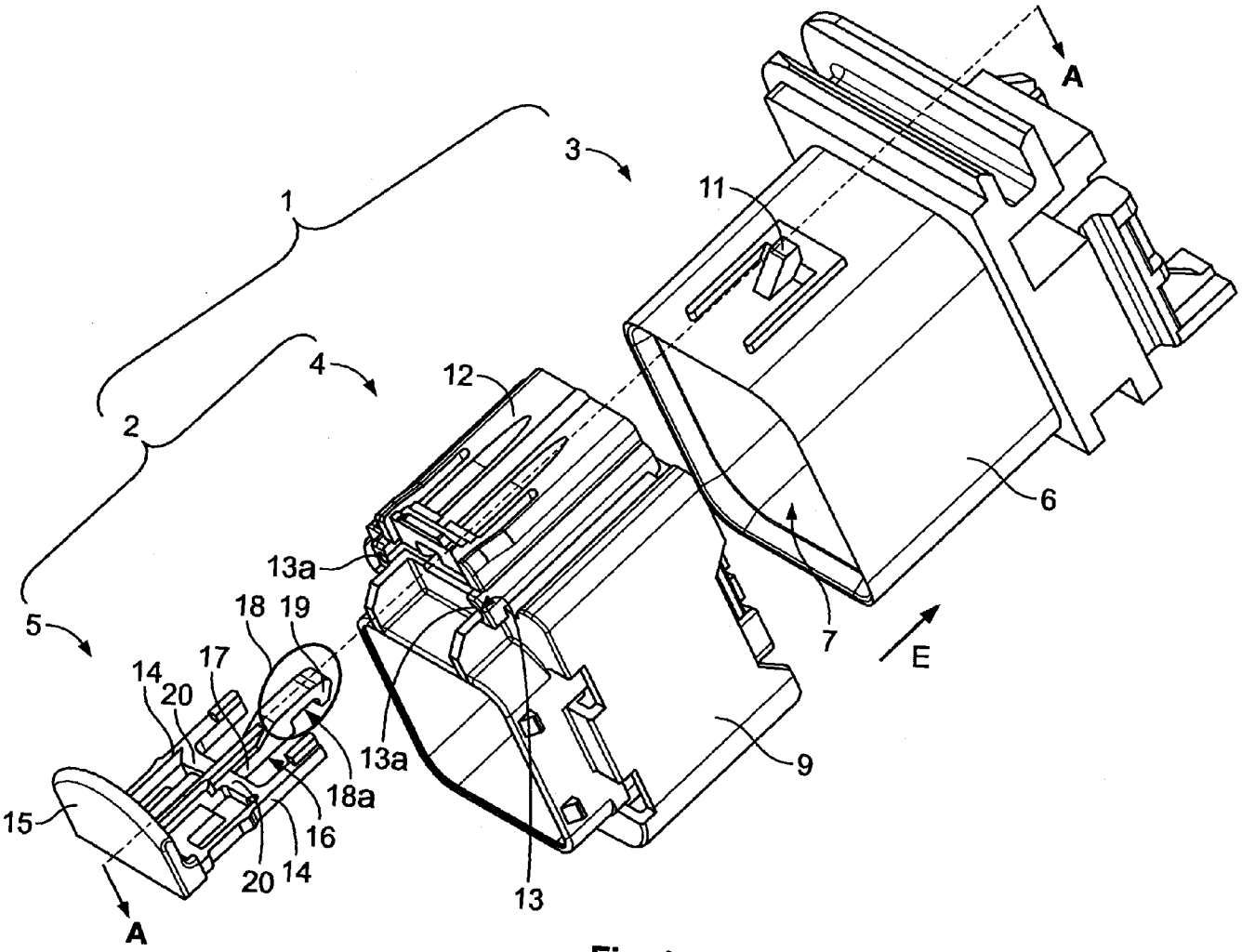
FIG. 1 is a perspective view of a first embodiment of a plug combination and plug-in connection according to the invention in the assembled configuration.
Figure 2:
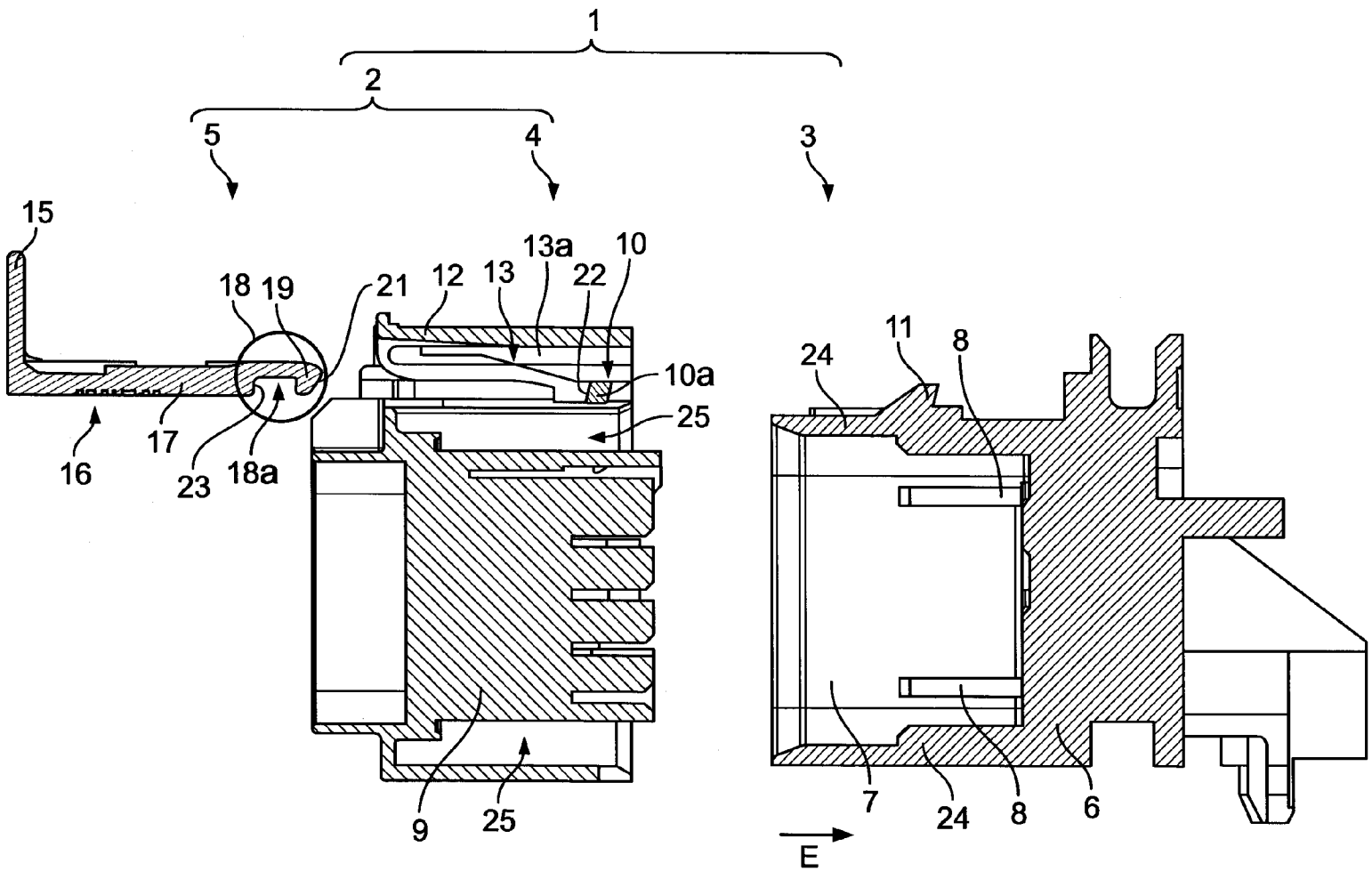
FIG. 2 is a sectional view along line A-A of the plug combination and plug-in connection according to the invention shown in FIG. 1 in the assembled configuration.

FIGS. 1 to 5 show a first embodiment of the plug-in connection 1 according to the invention comprising a plug combination 2 and a mating plug 3. FIGS. 1 and 2 show the plug-in connection 1 and plug combination 2, which comprises a plug 4 and a verification element 5, in the assembled configuration in which the plug 4 and verification element 5 are separate from one another.

The mating plug 3 comprises a mating plug body 6 which forms a receiving space 7 in which electrical contact pins 8 are arranged. The electrical contact pins 8 of the mating plug 3 extend substantially in a plug-in direction E in which the plug 4 and mating plug 3 are connected together.

The plug 4 comprises a plug body 9 and electrical mating contacts (not shown) arranged on the plug body 9. When the plug 4 and the mating plug 3 are connected together in the plug-in direction E so as to close the plug-in connection 1, the electrical contact pins 8 are electrically connected to the corresponding electrical mating contacts of the plug 4. In addition to the electrical connection, the plug 4 and mating plug 3 are prevented from being pulled apart when in the end connection configuration, shown in FIGS. 4 and 5, by a latching mechanism. The plug thus comprises a latching element 10 and the mating plug 3 comprises a counter-latching element 11. In the end connection configuration shown in FIG. 5 the counter-latching element 11 is engaged with the latching element 10 of the plug 4 and prevents the plug 4 and mating plug 3 from being pulled apart since the latching element 10 of the plug is arranged behind the counter-latching element 11 of the mating plug 3 in the plug-in direction E.

The latching element 10 is arranged in a housing 12 of the plug body 9. This housing receives the verification element 5, at least in part. In the pre-connection configuration shown in FIG. 3 the verification element 5 is arranged in the housing 12 in part and is securely attached to the plug. The housing 12 comprises two opposing guide grooves 13 which define the direction of insertion and removal of the verification element 5 from the plug 4. The guide grooves 13 extend in the plug-in direction E and the verification element 5 is inserted inside the housing 12 in the plug-in direction E so the plug combination can pass from the assembled configuration shown in FIG. 2, in which the plug 4 and verification element 5 are separate, into the pre-connection configuration shown in FIG. 3, in which the verification element 5 is securely attached to the plug 4 so as to be prevented from being removed.

The verification element 5 comprises two parallel guide pins 14 as guide projections which can be inserted into the guide grooves 13 of the housing 12 at the plug 4.

The verification element 5 further comprises an operable region 15 which is configured as a gripping plate which, at the end pointing against the plug-in direction E, is attached to the verification element 5. The operable region 15 holds the verification element 5 in place and during the transition towards the pre-connection configuration is inserted inside the housing 12 of the plug or, once the end connection configuration has been achieved, is removed from the plug 4.

The verification element 5 of the first embodiment shown in FIGS. 1 to 5 is configured with a connection element 16. The connection element 16 is a resiliently deformable spring arm 17 which extends substantially from the operable region 15 in the plug-in direction E. A first fixing means 18 is formed at the insertion-side tip of the spring arm 17. In the embodiment shown in FIGS. 1 to 5 the first fixing means 18 is a fixing recess **18*a* formed in the spring arm, a fixing hook 19 being formed at the end of the spring arm 17** pointing in the plug-in direction E.

The verification element 5 further comprises two connection bars 20, each one of which connects a guide pin 14 to the spring arm 17. The two guide pins 14, the spring arm 17 and the two connection bars 20 are arranged substantially in a single plane in such a way that the spring arm 17 of the verification element 5 of this embodiment is arranged, in its idle state, substantially parallel to the guide pins 14 and thus in the plug-in direction E.

With the aid of the plug-in connection and plug combination shown in FIGS. 1 to 5, the method according to the invention for checking the connection state of a plug-in connection 1 prevented from being pulled apart can be carried out. The method according to the invention comprises the following steps:

a) securely attaching the verification element to the plug;

b) connecting the plug and mating plug;

c) locking together the plug and mating plug whilst simultaneously releasing the attachment of the verification element; and d) removing the verification element from the plug.

Figure 3:
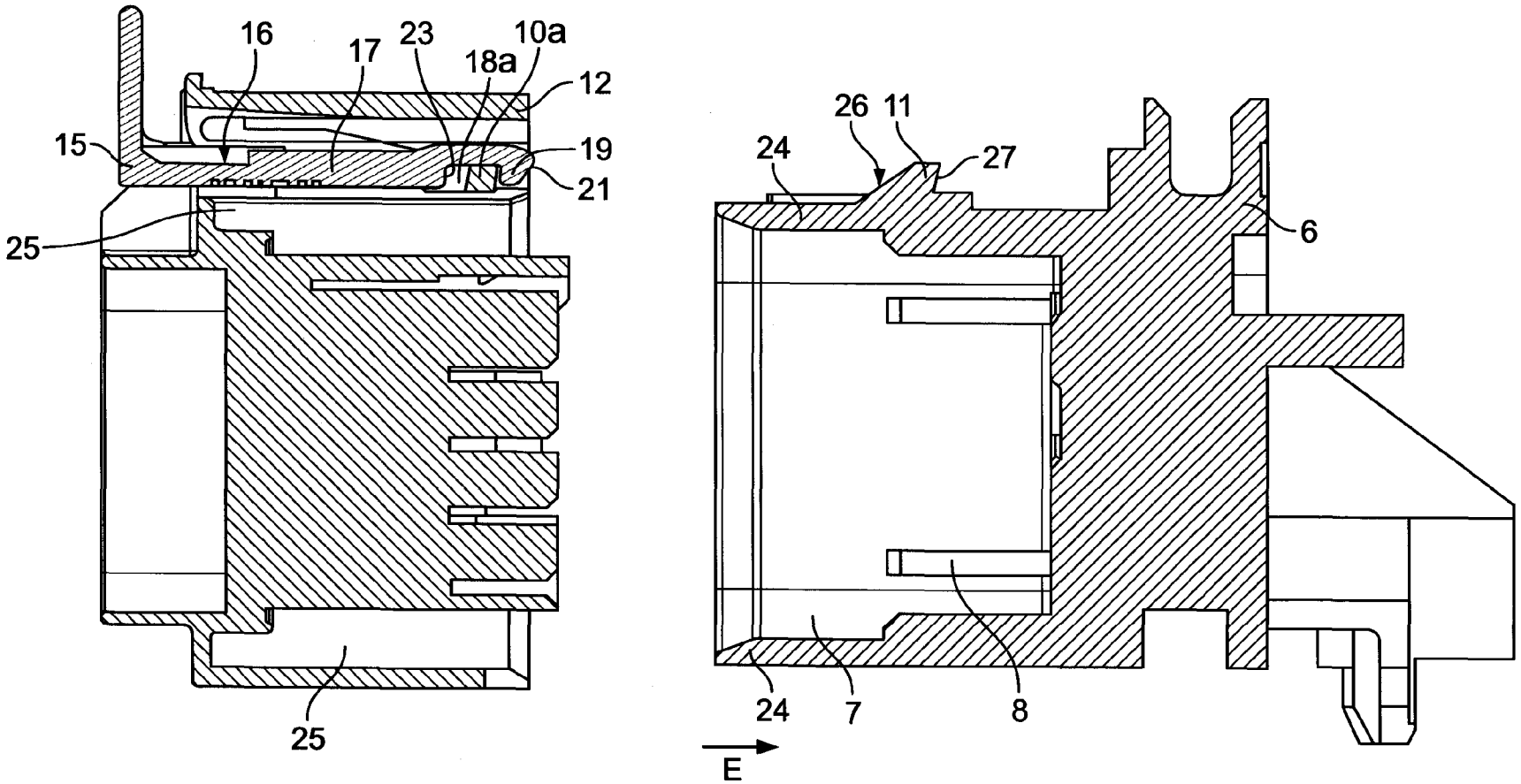
FIG. 3 is a sectional view of a first embodiment of the plug combination and plug-in connection according to the invention in the pre-assembled configuration.
Figure 4:
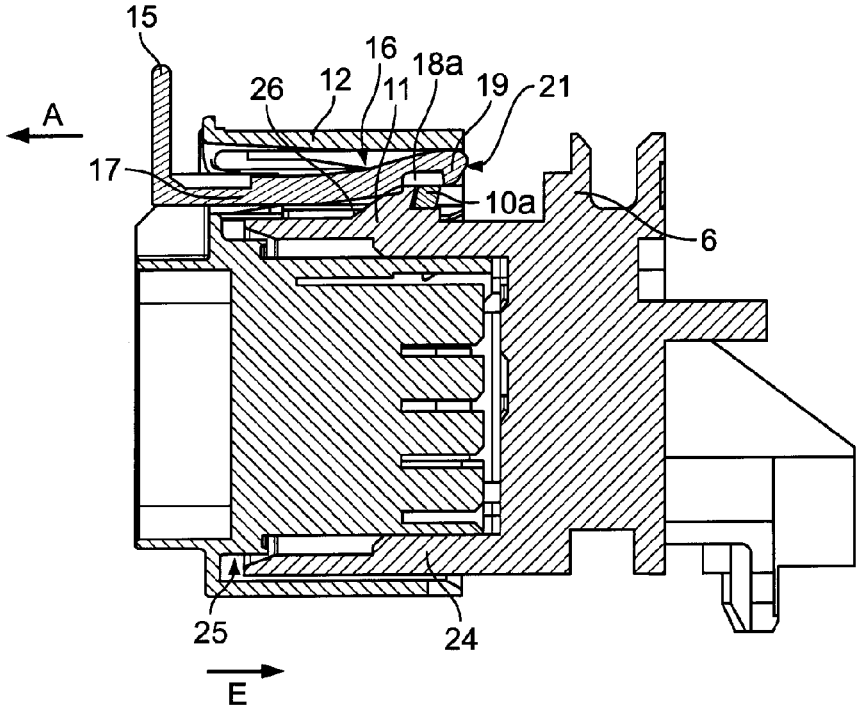
FIG. 4 is a sectional view of a first embodiment of the plug-in connection according to the invention in the end connection configuration with a released verification element.
Figure 5:
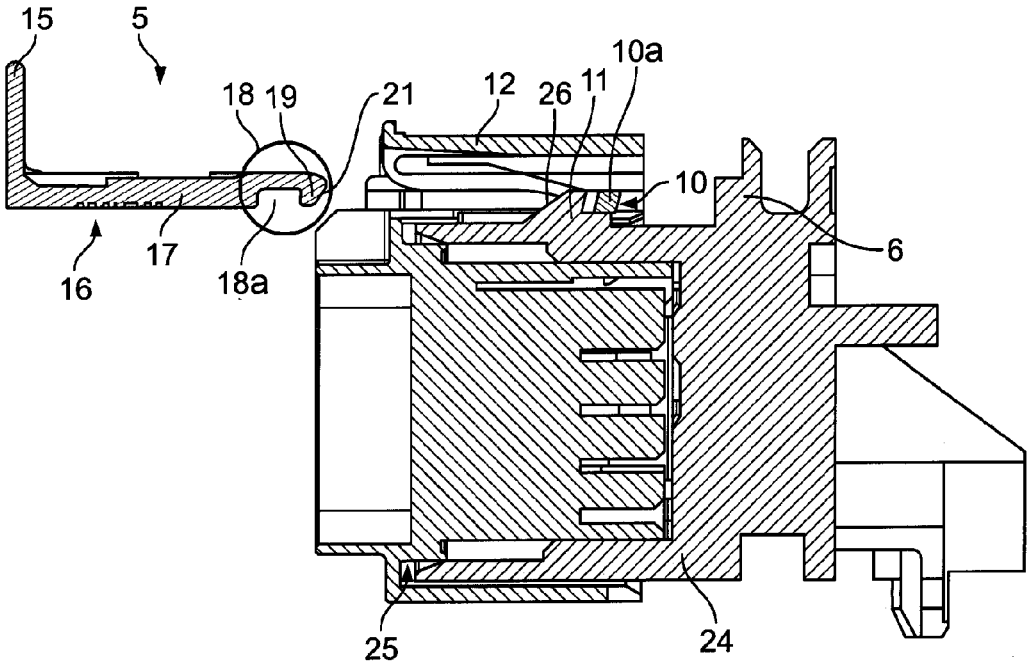
FIG. 5 is a sectional view of a first embodiment of the plug-in connection according to the invention in the end connection configuration with a removed verification element.

The individual steps of this method are shown in FIGS. 2 to 5, in which the transition from FIG. 2 to FIG. 3 (step a)), the transition from FIG. 3 to FIG. 4 (steps b) and c)) and the transition from FIG. 4 to FIG. 5 (step d)) are shown. The individual method steps will be described hereinafter with reference to the drawings shown in FIGS. 2 to 5 for the first embodiment of the plug-in connection according to the invention.

In order to securely attach the verification element 5 to the plug 4, the verification element 5 shown in FIG. 2 is manipulated at the operable region 15 and inserted in the plug-in direction E into the housing 12 of the plug 4, with the fixing hook 19 of the spring arm 17 at the front. The guide pins 14 each engage in the respective guide groove 13 and define the plug-in direction E. At the same time, the guide groove 13 together with the guide pins 14 forms a positive connection for the verification element 5 on the housing 12 of the plug 4 transverse to the plug-in direction E. During the transition from the assembled configuration of the plug combination shown in FIG. 2 into the pre-connection configuration shown in FIG. 3, the fixing hook 19 of the spring arm 17 contacts the latching element 10 of the plug 4 when the verification element 5 is inserted in the plug-in direction E. At its end pointing in the plug-in direction E the fixing hook 19 comprises a deflection bevel 21 which is arranged transverse to the plug-in direction E. The latching element 10 comprises a corresponding bevelled edge 22. When the verification element 5 is inserted in the plug-in direction E, the deflection bevel 21 contacts the bevelled edge 22, the spring arm 17 being deflected, the fixing hook 19 bypassing the latching means 10 in the plug-in direction E and the plug combination 2 passing into the pre-connection configuration.

In the pre-connection configuration which is shown in FIG. 3, the spring arm 17 of the verification element 5 again extends substantially in the plug-in direction E. The fixing hook 19 is thus arranged behind the latching means 10 of the plug 4 in the plug-in direction E, which plug represents the second fixing means of the attachment in the first embodiment. The verification element 5 is thus securely attached to the plug 4 via the connection element 16 so as to be prevented from being removed. The verification element 5 cannot be removed in the plug-in direction E, since the operable region 15 would contact the housing 12 of the plug or the edge 23 of the fixing recess 18*a* pointing against the plug-in direction E would contact the latching element 10. The latching means 10 engages behind the fixing hook 19 against the plug-in direction E and prevents removal in this direction. The guide of the two guide grooves 13, in which the guide pins 14 of the verification element 5 are arranged, prevents the verification element 5 from being removed in any direction transverse to the plug-in direction E.

The connection between the plug 4 and mating plug 3 as well as the locking together of the plug 4 and mating plug 3 whilst simultaneously releasing the attachment of the verification element 5 will be described hereinafter with reference to FIG. 4, in which the plug-in connection 1 according to the invention is shown in the end connection configuration with a released, but not yet removed verification element 5.

If the mating plug 3 and the plug combination 2 according to the invention and in the pre-connection configuration, in which the verification element 5 is securely attached to the plug 4 via the connection element 16 so as to be prevented from being removed and in which the plug 4 and mating plug 3 are separate, are connected in the plug-in direction E, the plug 4 and mating plug 3 are securely locked together so as to be prevented from being pulled apart. The attachment of the verification element 5 is released at the same as this locking process, as shown in FIG. 4.

When the plug 4 and mating plug 3 are connected, the electrical contact pins 8 are electrically connected to the corresponding electrical mating contacts. The plug body 9 is also guided, in part, inside the receiving space 7 of the mating plug 3. The casing 24 which delimits the receiving space 7 of the mating plug 3 transverse to the plug-in direction E, is received during connection in corresponding recess openings 25 in the plug body 9. In the present invention, the plug-in direction E is defined as the direction in which the plug 4 is inserted into the mating plug 3, the mating plug 3 being fixed in place.

When the plug 4 is inserted in the plug-in direction E the contact latching element 11, which is configured as a counter-latching lug 11 projecting on the outer side of the casing face 24, initially contacts the deflection bevel 21 of the fixing hook 19. The counter-latching lug 11 comprises a latching bevel 26 against the plug-in direction E, which bevel is oriented substantially transverse to the plug-in direction E so as to correspond with the deflection bevel 21 of the fixing hook 19. When inserting the plug 4 in the plug-in direction E, the fixing hook 19 slides along the latching bevel 26 and is accordingly deflected. The latching element 10 also slides along the latching bevel 26 in such a way that the plug 4 and mating plug 3 can be connected in the plug-in direction E. Once the fixing hook 19 and the latching means 10 have been lifted above the counter-latching lug 11 of the mating plug 4, the latching means 10 engages with the counter-latching edge 27 of the counter-latching lug 11 pointing in the plug-in direction E. The latching means 10 is thus arranged behind the counter-latching lug 11 in the plug-in direction E, the plug 4 and mating plug 3 being prevented from being pulled apart against the plug-in direction E. It is thus only possible to pull the plug 4 out of the mating plug 3 against the plug-in direction E when the latching means 10 is released from its attachment with the latching edge 27 of the counter-latching element 11.

In the end connection configuration shown in FIG. 4, the attachment of the verification element 4 is released. The connection element 16 is released from the counter-latching element 11 in such a way that the fixing recess 18*a* is raised above the latching element 10 and the fixing hook 19 is released from its engagement with the latching element 10 against the plug-in direction E. The verification element 5 can thus be removed from the plug in a removal direction A which is opposite to the plug-in direction E.

The connection element 16 is thus released in that the connection element 16 is actuated by the counter-latching element 11 of the mating plug 3, i.e. in that the spring arm 17 is deflected by the counter-latching element 11 transverse to the plug-in direction E into a release position. The actuation process which releases the first fixing means 18 of the spring arm 17 is achieved in that the counter-latching lug 11 is arranged in the end connection configuration in a position in which part of the spring arm 17 is arranged in the pre-connection configuration. The counter-latching element 11 pushes the portion of the spring arm 17 which, in the pre-connection configuration, is arranged in the region of the plug 4 associated with the counter-latching element 11 and thus deflects the spring arm 17. This deflection releases the first fixing means 18, the fixing recess 18*a* in the spring arm 17 and the fixing hook 19 formed by said fixing recess 18*a* from engagement with the latching element 10 of the plug 4 against the plug-in direction E. The verification element 5 can thus be removed from the plug in the removal direction A which is oriented against the plug-in direction E.

This state is shown in FIG. 5, which shows the correctly connected plug-in connection with the plug 4 and mating plug 3 in the connection state and locked together so as to be prevented from being pulled apart, the verification element 5 having been removed from the plug 4 and being separate therefrom.

FIGS. 6 to 10 show a second embodiment of the plug combination 2 and a plug-in connection 1 according to the invention. Like numerals will be used hereinafter for parts which are structurally and/or functionally similar or identical to parts of the first embodiment. Only the differences between the second embodiment and the first embodiment will be discussed below.

Figure 6:
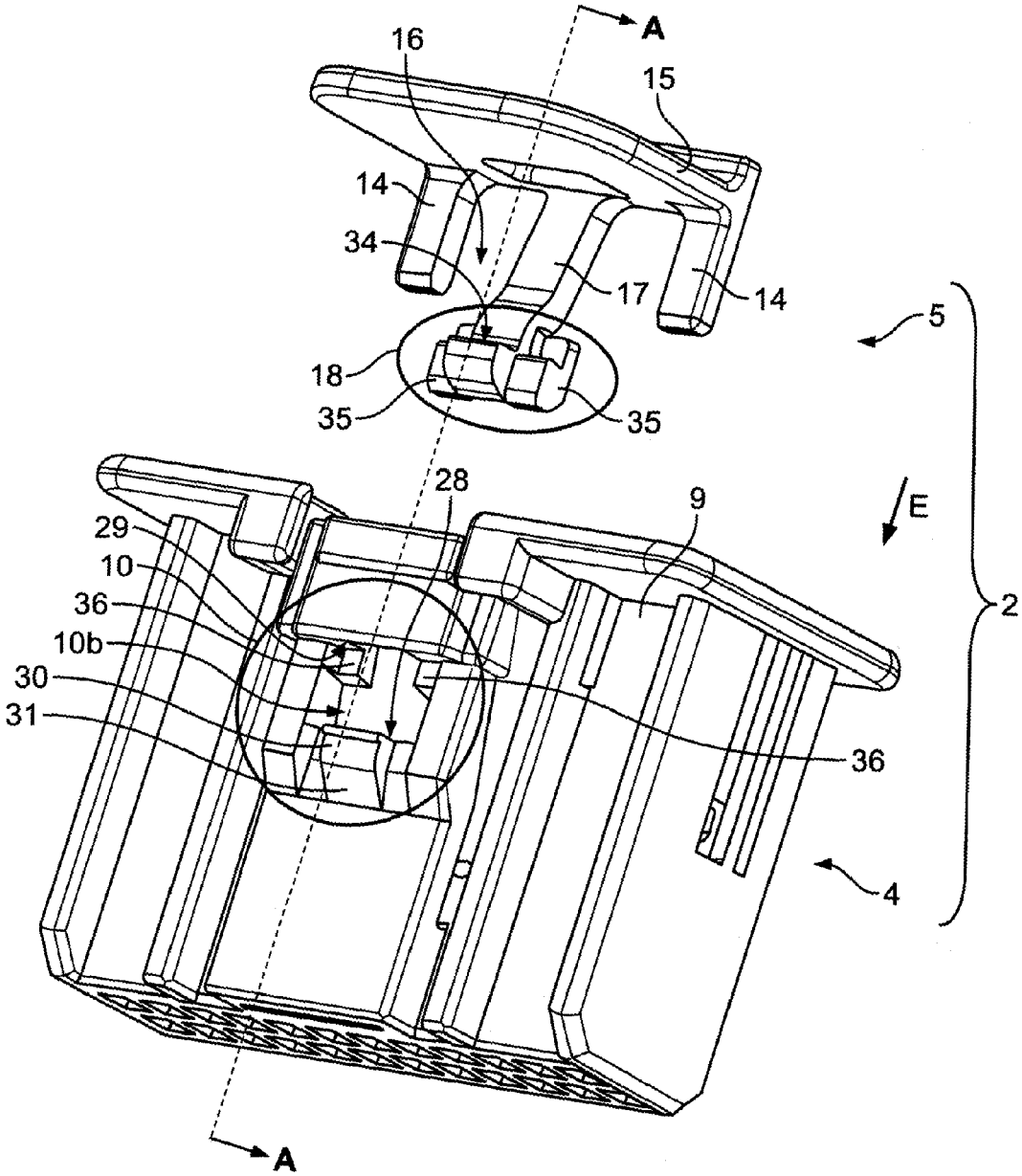
FIG. 6 is a perspective view of a second embodiment of a plug combination according to the invention.
Figure 7:
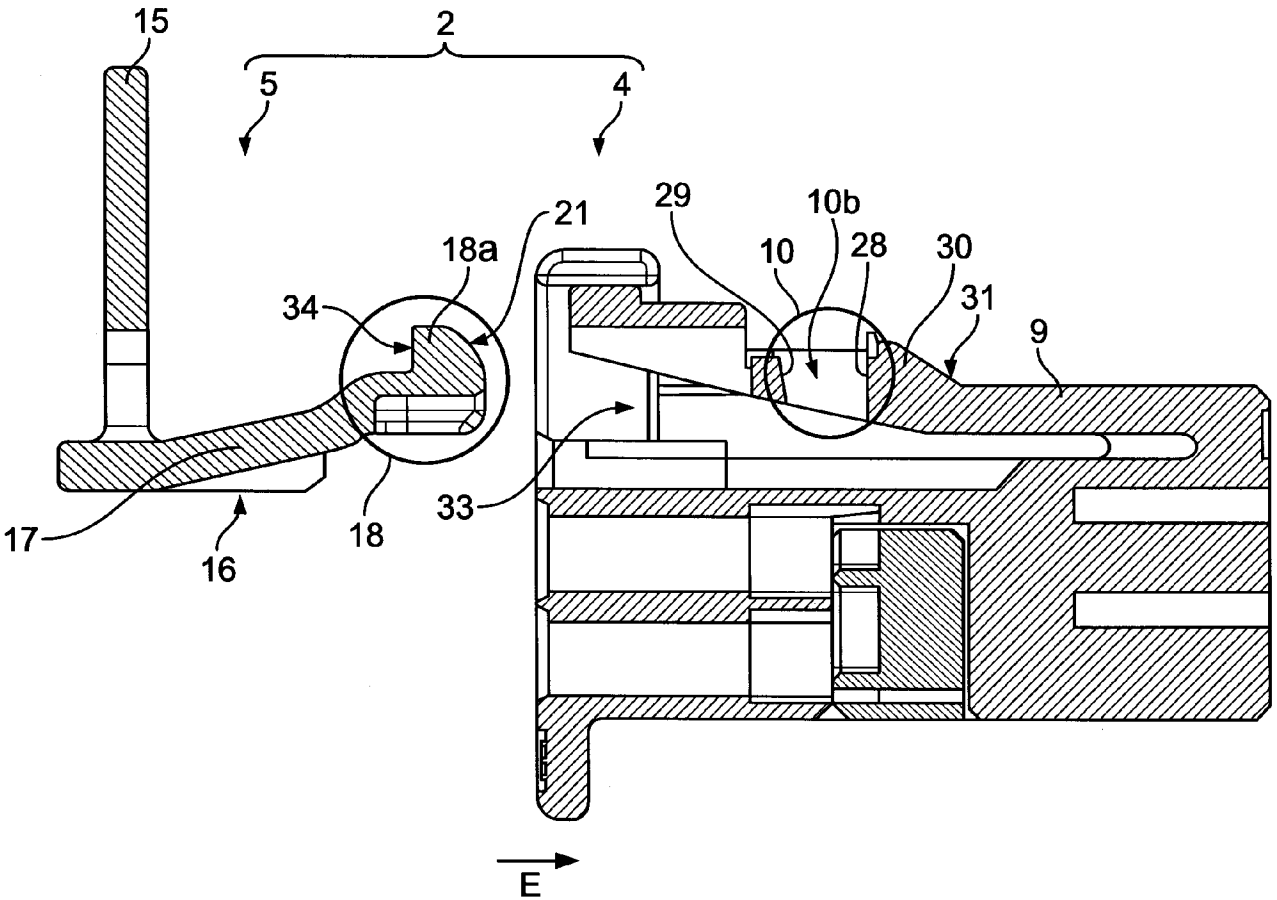
FIG. 7 is a sectional view of the plug combination according to the invention of FIG. 6 taken along line A-A.

FIGS. 6 and 7 show the second embodiment of the plug combination 2 according to the invention in the assembled configuration, in which the plug 4 and verification element 5 are separate.

The plug 4 comprises a plug body 9 which can be inserted into the socket body 9 of the mating plug 3. The plug 4 of the second embodiment comprises a latching opening 10*b* as a latching element 10, which opening can be engaged with the counter-latching element 11 (the counter-latching lug 11) of the mating plug 3, the plug 4 and mating plug 3 being prevented from being pulled apart when in the end connection configuration, shown in FIG. 10. The latching opening 10*b* comprises two stops 28 and 29. The first stop is the latching stop 28 which is formed on the side of the latching opening 10*b* pointing in the plug-in direction E. This latching stop 28 is engaged with the counter-latching lug 11 of the mating plug 3 in the end connection configuration and prevents the plug 4 and mating plug 3 from being pulled apart.

When the plug 4 is inserted into the mating plug 3 in the plug-in direction E, the counter-latching lug 11 of the mating plug 4 contacts the latching stop-side edge 30 of the latching opening 10*b* of the plug 4 pointing in the plug-in direction E. The region of the latching stop-side edge 30 is provided with a latching bevel 31 which deflects the counter-latching lug 11 transverse to the plug-in direction E during the connection process in the plug-in direction E. The arm 32 of the counter-latching element 11, on the end of which counter-latching element pointing away from the plug-in direction E the counter-latching lug 11 is formed, is thus resiliently deformed. In the end connection configuration the latching stop 28 is arranged behind the counter-latching lug 11 in the plug-in direction E and is engaged therewith.

The stop face arranged on the end of the latching opening 10*b* arranged against the plug-in direction E is the fixing stop 29. Said fixing stop 29 forms the second fixing means 18 of the plug 4 which, together with the first fixing means 18 of the connection element 16 which is formed on the verification element 5, securely attaches the verification element 5.

The verification element 5 of the second embodiment also comprises two guide pins 14 which substantially correspond with the guide pins 14 of the first embodiment. However, the guide pins of the second embodiment project substantially freely in the plug-in direction E, since no connection bars are provided on the verification element 5 in the second embodiment. The connection element 16 is again provided with a spring arm 17 which is not arranged in a single plane with the spring arms 14, however, but projects slightly transverse from the plane in which the two guide arms 14 extend. The angle of inclination of the spring arm 17 from the plane in which the guide arms 14 extend is approximately 10 to 20°.

The first fixing means 18 of this embodiment is a fixing lug 18*b* which is raised above the end of spring arm 17 pointing in the plug-in direction E. The side of the fixing lug pointing in the plug-in direction E is rounded and forms the deflection bevel 21. The fixing lug 18*b* is widened opposite the spring arm 17 by laterally formed L-shaped attachments 35, the fixing face, via which the fixing lug 18*b* is engaged with the latching opening 10*b* in the pre-connection configuration, being expanded.

During the transition process of the plug combination 2 according to the invention and of the second embodiment, the verification element 5 is inserted into an insertion shaft 33 of the plug 4 substantially in the plug-in direction E. The insertion direction is thus guided in a controlled manner by the two guide pins 14 of the verification element 5 and by corresponding guide grooves (not shown) of the insertion shaft 33. The insertion direction is provided by the guide grooves of the plug 4 extending substantially in the plug-in direction E.

Figure 8:
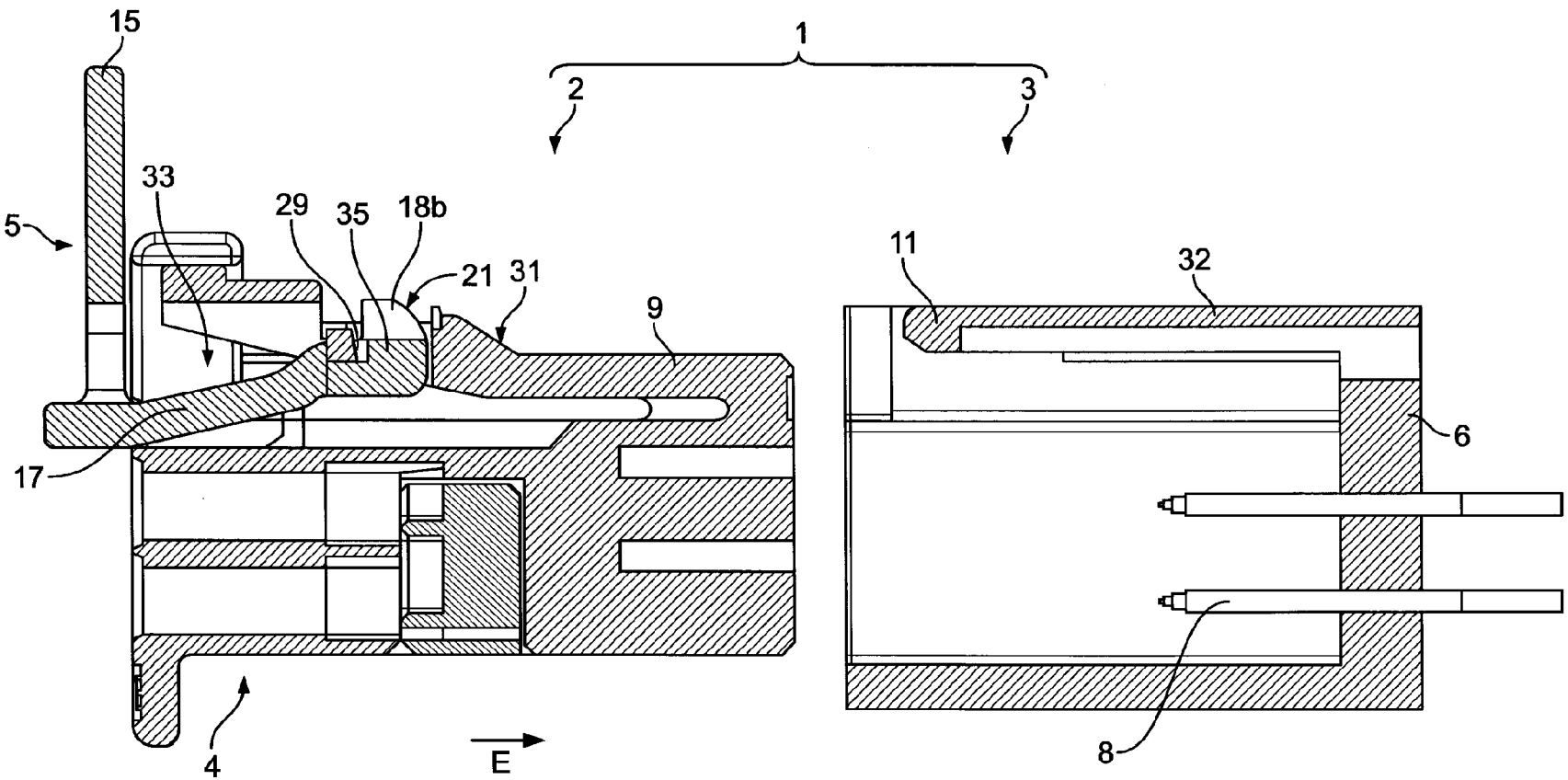
FIG. 8 is a sectional view of a second embodiment of the plug combination according to the invention from FIG. 7 in the pre-assembled configuration and together with the mating plug of the second embodiment of the plug-in connection according to the invention.

During the transition from the assembled configuration shown in FIGS. 6 and 7, in which the verification element 5 and the plug 4 are separate, into the pre-connection configuration shown in FIG. 8, the verification element 5 is securely attached to the plug 4 via the connection element 16 so as to be prevented from being removed.

When inserting the verification element 5 in the plug-in direction E into the insertion shaft 33, the deflection bevel 21 of the fixing lug 18*b* pointing in the plug-in direction E contacts the region of the plug housing 9 which abuts the fixing stop 29. The spring arm 17 is thus deflected in such a way that it extends substantially in the plug-in direction E. If the fixing lug 18*b* is guided further in the plug-in direction, it contacts the counter-latching opening 10*b* of the plug 4 and locks therewith. The spring arm 17 returns to its idle position directed transverse to the plug-in direction E.

In this pre-connection configuration which is shown in FIG. 8, the stop face 34 of the fixing lug 18*b* (the side face pointing against the plug-in direction E) engages with the fixing stop face 29 of the latching opening 10*b*. The fixing lug 18*b* is arranged behind the fixing stop 29 in the plug-in direction E, the verification element 5 being prevented from being removed in the removal direction A which extends in the direction opposite to the plug-in direction E. The L-shaped attachments 35 are arranged on projections 36 of the fixing stop 29 which, in the pre-connection configuration, are arranged at the angle formed by the L-shaped attachments. The lateral outer faces of the attachments are also arranged at the edge of the latching opening 10*b*. The attachments 35 thus fix the fixing lug 18*b* not only against the plug-in direction E, but also transverse to the plug-in direction E. The only way to release the fixing lug 18*b* from the fixing stop 29 is to deflect the fixing lug 18*b* in the direction of the inner space of the plug in such a way that the spring arm is displaced in the plug-in direction E.

In the plug-in direction E both the operable face 15 of the verification element 5, which contacts the plug body 9, and the tip of the fixing lug 18*b* pointing in the plug-in direction E and arranged on the latching stop 28 of the latching opening 10*b* delimit displacement in the plug-in direction. The verification element 5 is fixed transverse to the plug-in direction E by the guide pins 14 arranged in the guide grooves. The verification element 5 is thus securely attached to the plug 4 in the pre-connection configuration so as to be prevented from being removed.

Figure 9:
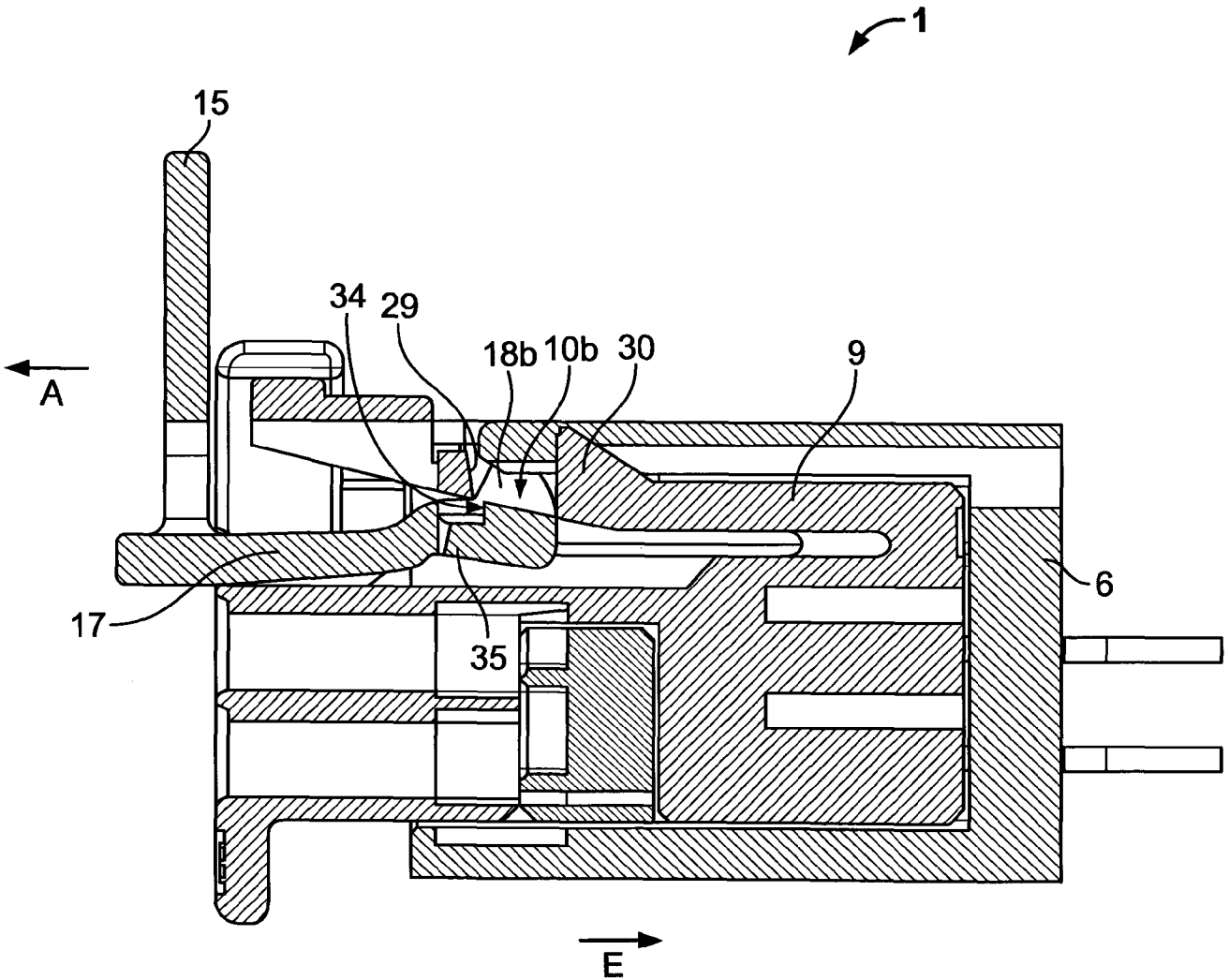
FIG. 9 is a sectional view of a second embodiment of the plug-in connection according to the invention in the end connection configuration and with a released verification element.

When the plug combination 2 in the pre-connection configuration of FIG. 8 is connected to the mating plug 3 in the plug-in direction E, the plug 4 and mating plug 3 lock together whilst the attachment of the verification element 5 is simultaneously released. This is shown in FIG. 9.

Figure 10:
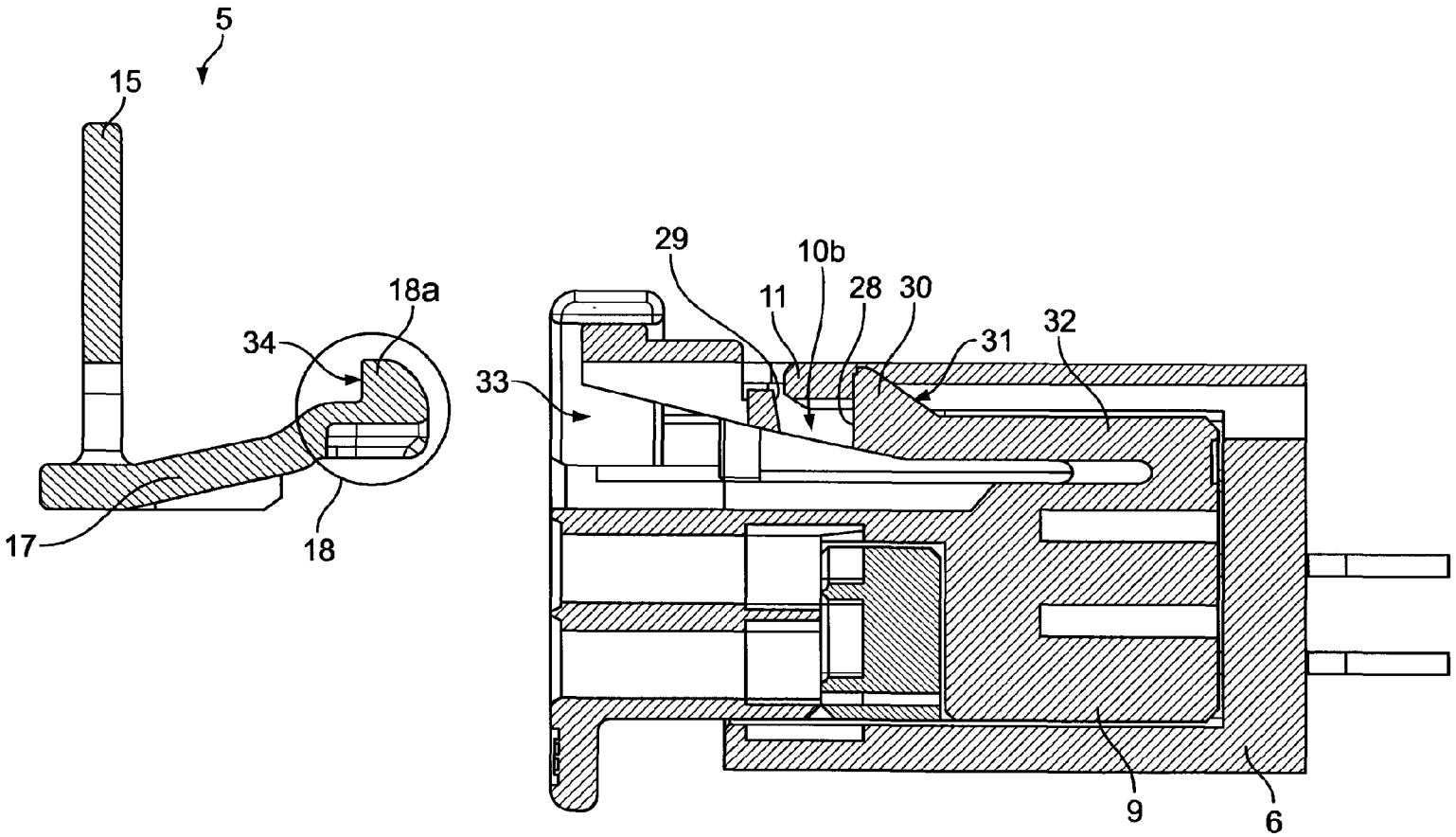
FIG. 10 is a sectional view of a second embodiment of the plug-in connection according to the invention in the end connection configuration and with a removed verification element.

The fixing lug 18*b* (the first fixing means 18 in the second embodiment) cooperates with the fixing stop 29 of the latching opening 10*b* (second fixing means of the plug 4) as an attachment which attaches the verification element 5 to the plug 4. In the pre-connection configuration the fixing lug 18*b* is arranged in the region of the plug 4 in which the counter-latching element 11 of the mating plug 3 is arranged in the end connection configuration. In the end connection configuration, the counter-latching lug 11 of the mating plug 4 displaces the fixing lug 18*b* of the spring arm 17 of the verification element 5. This displacement deflects the spring arm 17 and deforms it into a release position shown in FIG. 9, in which the spring arm 17 extends substantially in the plug-in direction E. As a result of the deflection, the stop face 34 of the fixing lug 18*b* is moved out of engagement with the fixing stop 29 of the latching opening 10, and the connection element 16, namely the spring arm 17 with the fixing lug 18*b* of the verification element 5, is released in the removal direction A. The verification element 5 may thus, in the end connection configuration, be removed from the plug in the removal direction A as soon as the plug 4 is locked with the mating plug 3 and secured against being pulled out. This end position of the plug-in connection prevented from being pulled apart, from which the verification element 5 has been removed, is shown in FIG. 10.

The invention claimed is:

1. A method for checking the connection state of a plug-in connection prevented from being pulled apart using a plug, a mating plug having a counter-latching element and a verification element having a connection element, comprising the following steps:

a) securely attaching the verification element to the plug;

b) connecting the plug and mating plug;

c) locking together the plug and mating plug, guiding the connection element by the counter-latching element into a release position whilst simultaneously releasing the attachment of the verification element; and d) removing the verification element from the plug.

2. A method according to claim 1, wherein in step a) the verification element and the plug are locked together.

3. A method according to claim 1, wherein in step c) the verification element is released by locking together the plug and mating plug.

4. A method according to claim 1, wherein in step d) the verification element is removed against the plug-in direction (E) in which the plug and mating plug are connected in step b).

5. A plug combination for a checkable plug-in connection, having a plug which comprises at least one latching element, which can be engaged with at least one counter-latching element of a mating plug and is configured so as to prevent the plug and mating plug from being pulled apart when in an end connection configuration, and having a verification element which can be securely attached to the plug via a connection element, the plug combination being configured so as to be able to pass from an assembled configuration, in which the plug and verification element are separate from one another, into a pre-connection configuration, in which the verification element is securely attached to the plug via the connection element so as to be prevented from being removed, wherein the connection element comprises a release means arranged so as to be able to be guided by the counter-latching element into a release position, in which the attachment of the connection element is released and the verification element can be removed from the plug.

6. A plug combination according to claim 5, wherein the release means is arranged in a region in which the at least one counter-latching element is arranged in the end connection configuration.

7. A plug combination according to claim 5, wherein the release means is formed on a resiliently deformable spring arm of the connection element.

8. A plug combination according to claim 5, wherein the spring arm comprises a first fixing means which, together with a second fixing means, forms the attachment of the connection element in the pre-connection configuration.

9. A plug combination according to claim 8, wherein the first fixing means is a fixing lug projecting from the spring arm, which lug engages in a latching opening forming the second fixing means in the pre-connection configuration.

10. A plug combination according to claim 8, wherein the first fixing means is a fixing recess formed in the spring arm, in which recess a lug projection forming the second fixing means engages in the pre-connection configuration.

11. A plug combination according to claim 8, wherein the release means is provided on the first fixing means.

12. A plug combination according to claim 5, wherein the connection element is formed on the verification element.

13. A plug combination according to claim 5, wherein the plug may comprise a guide extending in a removal direction (A) for removing the verification element.

14. A plug combination according to claim 13, wherein the guide comprises at least one guide groove extending substantially in the removal direction (A) which groove is configured so as to cooperate with at least one guide projection of the verification element.

15. A checkable plug-in connection comprising a plug having at least one latching element, a verification element which is secured to the plug via a connection element so as to be prevented from being removed, and a mating plug which can be connected to the plug and comprises at least one counter-latching element, the plug-in connection being configured so as to be able to pass from a pre-connection configuration, in which the verification element is prevented from being removed from the plug by the connection element and in which the plug and mating plug are separate from one another, into an end connection configuration, in which the at least one counter-latching element is engaged with the at least one latching element and in which the plug and mating plug are prevented from being pulled apart, wherein in the end connection configuration the connection element is released by the at least one counter-latching element and the verification element can be removed from the plug, wherein the plug and verification element form a plug combination.

* * * * *